US009587392B2

(12) United States Patent
Pasco

(10) Patent No.: US 9,587,392 B2
(45) Date of Patent: Mar. 7, 2017

(54) WATER PUMPING STATION WITH AN INTEGRAL VALVE VAULT

(71) Applicant: Oldcastle Precast, Inc., Auburn, WA (US)

(72) Inventor: Ken Pasco, Burlington, CT (US)

(73) Assignee: Oldcastle Precast, Inc., Auburn, WA (US)

( * ) Notice: Subject to any disclaimer, the term of this patent is extended or adjusted under 35 U.S.C. 154(b) by 124 days.

(21) Appl. No.: 14/268,803

(22) Filed: May 2, 2014

(65) Prior Publication Data

US 2014/0326332 A1 Nov. 6, 2014

Related U.S. Application Data

(60) Provisional application No. 61/818,700, filed on May 2, 2013.

(51) Int. Cl.
*E03F 5/22* (2006.01)

(52) U.S. Cl.
CPC ..... *E03F 5/22* (2013.01); *Y10T 29/49229* (2015.01); *Y10T 137/6991* (2015.04); *Y10T 137/6995* (2015.04)

(58) Field of Classification Search
CPC .. E03F 5/22; Y10T 137/402; Y10T 137/6991; Y10T 137/6995; Y10T 137/7313; Y10T 137/86356
USPC ..... 52/19, 20, 21; 137/363, 364
See application file for complete search history.

(56) References Cited

U.S. PATENT DOCUMENTS

| | | | | |
|---|---|---|---|---|
| 3,112,760 | A | 12/1963 | Budd | |
| 3,150,792 | A | 9/1964 | Bright | |
| 3,461,803 | A * | 8/1969 | Stothoff | F04D 15/0218 137/363 |
| 3,552,408 | A * | 1/1971 | Dowdican | E03F 5/22 137/13 |
| 3,592,564 | A * | 7/1971 | Conery | F04D 29/607 222/385 |
| 3,672,103 | A | 6/1972 | Kost | |
| D235,168 | S | 5/1975 | Boyer et al. | |
| 3,938,545 | A | 2/1976 | Nagy et al. | |

(Continued)

FOREIGN PATENT DOCUMENTS

FR 2728292 A1 * 6/1996 ..... E03F 5/22

OTHER PUBLICATIONS

Notice of Allowance for U.S. Appl. No. 29/479,357, mailed Apr. 23, 2015 12 pages.

(Continued)

*Primary Examiner* — Mary McManmon
*Assistant Examiner* — Richard K Durden
(74) *Attorney, Agent, or Firm* — Sheridan Ross P.C.

(57) ABSTRACT

A waste or storm water pumping station and system used to pump water from a lower elevation to a higher elevation during the process of moving or managing the water is disclosed herein. The pumping station has a wet well collection chamber with a sloped floor and an integral valve vault chamber cast within the pump station body, which results in increased storage capacity in the wet well chamber for pump station components. Additionally, the pumping station may be installed as a single unit of equal depth to eliminate differential settlement and multiple or uneven excavations.

14 Claims, 5 Drawing Sheets

(56) References Cited

U.S. PATENT DOCUMENTS

| | | | | |
|---|---|---|---|---|
| 3,957,633 | A * | 5/1976 | Gatti | C02F 3/1294 210/104 |
| 3,974,599 | A | 8/1976 | Grosh | |
| 4,023,590 | A * | 5/1977 | Harris | E02D 29/12 137/363 |
| 4,178,139 | A | 12/1979 | Seppanen et al. | |
| 4,655,361 | A | 4/1987 | Clover et al. | |
| 4,679,991 | A | 7/1987 | Harbison et al. | |
| 5,271,193 | A * | 12/1993 | Olsen | B28B 7/38 52/169.7 |
| 5,334,000 | A | 8/1994 | Nordlin | |
| 5,358,385 | A | 10/1994 | Wang | |
| 5,772,361 | A | 6/1998 | Gavin | |
| 6,644,342 | B1 * | 11/2003 | Bogan | E02D 29/121 137/364 |
| 6,854,479 | B2 | 2/2005 | Harwood | |
| 7,144,189 | B1 | 12/2006 | Bongiovanni et al. | |
| 7,150,290 | B1 | 12/2006 | Smith | |
| 7,665,250 | B2 * | 2/2010 | Powell | E04B 1/20 52/236.4 |
| 8,083,851 | B2 * | 12/2011 | Crudden | A01N 59/16 106/724 |
| 8,348,553 | B2 * | 1/2013 | Simpson | E02B 3/02 405/15 |
| D693,849 | S | 11/2013 | Sofussen et al. | |
| D699,264 | S | 2/2014 | Sofussen et al. | |
| 8,835,757 | B2 | 9/2014 | Freeman | |
| 8,955,539 | B2 | 2/2015 | Early et al. | |

OTHER PUBLICATIONS

Notice of Allowance for U.S. Appl. No. 29/479,359, mailed Apr. 20, 2015 8 pages.
Notice of Allowance for U.S. Appl. No. 29/479,360, mailed Apr. 15, 2015 9 pages.
U.S. Appl. No. 29/479,357, filed Jan. 15, 2014, Pasco.
U.S. Appl. No. 29/479,359, filed Jan. 15, 2014, Pasco.
U.S. Appl. No. 29/479,360, filed Jan. 15, 2014, Pasco.

* cited by examiner

WATER PUMPING STATION WITH AN INTEGRAL VALVE VAULT

RELATED APPLICATION

This application claims priority from U.S. Provisional Patent Application Ser. No. 61/818,700, filed May 2, 2013, entitled "Water Pumping Station Having Integral Valve Vault," the entire disclosure of which is incorporated by reference herein.

FIELD OF THE INVENTION

Embodiments of the present invention relate generally to waste and storm water management, and more specifically to an improved waste or storm water pumping station and system.

BACKGROUND OF THE INVENTION

A variety of gravity-based systems have long been used to move waste and/or storm water through management and conveyance systems and on to treatment or storage systems. These management and conveyance systems often require pumping stations to lift the water from a lower elevation to a higher elevation such that gravity can be used to move the waste and/or storm water through the system. Lifting pump stations and systems typically have two major components: (1) a collection or pumping container (also referred to herein as a "pump chamber," a "collection chamber," a "wet well collection chamber," or a "wet well") for collecting and pumping the water up and out of the pump station; and (2) a valve chamber (also referred to herein as a "valve pit," a "valve vault," a "valve vault structure," or a "valve vault chamber") for monitoring and regulating equipment, such as a water meter, backflow preventer valve, or a pressure reducing valve.

While pumping stations have long been used to raise waste or storm water to higher elevations within a management and conveyance system, there are serious deficiencies and inadequacies with the prior art pumping systems. The two major components of the prior art systems, the wet well and the valve chamber, are housed in separate structures that must be connected to each other during installation. A significant problem with having two separate structures is that each structure will settle at a different rate and depth, commonly referred to as differential settlement. When differential settlement occurs, the piping between the two structures is compromised resulting in breaks and leaks that require excavating the area around and between the structures to repair the damage and stop the leaks. Even after a break has been repaired, there is still the possibility that the piping will break or leak again in the future.

While the problem of separate water pump station structures can be somewhat addressed by fixedly connecting the two separate structures together with fasteners such as bolts, as was done in U.S. Pat. No. 7,150,290 to Smith ("Smith"), which is herein incorporated by reference in its entirety, the problem of differential settlement can still occur due to the different sizes and depths of the two structures. Smith describes two differently sized structures connected together with fasteners after each structure is manufactured, resulting in a single structure having one shorter half and one longer half. When the soil settles around this structure the soil beneath and around the shorter half will settle differently than the soil beneath and around the longer half causing the structure to tilt to one side and possibly move out of plumb.

One other deficiency with the Smith structure is that the valve vault chamber is approximately one half the depth of the collection chamber, which results in space beneath the valve vault chamber that is filled with soil when it could be used to increase the storage capacity of the collection chamber. Additionally, the Smith invention requires additional time, labor, and skill to excavate a hole that is deeper for the longer collection chamber structure and shallower for the valve vault chamber structure. Installation of the Smith invention would require that either the two structures are installed separately and fastened together after being set in the hole, or that the excavation is uneven and at different depths to receive the combined structure. Either installation may result in differential settlement, which may cause the entire structure to tilt out of plumb.

There is, therefore, a need for a new waste and storm water pumping station and system that will facilitate the desired function of pumping water from one elevation to another while eliminating differential settlement and maximizing the storage capacity of the wet well collection chamber.

SUMMARY OF THE INVENTION

In view of the limitations in the prior art methods and systems, the present disclosure provides a new and useful water pumping station and system with a single-structure enclosure having an integral valve vault. The single-structure water pumping station and system is simpler in fabrication and installation, has a smaller footprint, eliminates differential settlement, requires a single tier excavation rather than a two-tier excavation, reduces the size and depth of the excavation required, and improves safety. Embodiments of the present invention are also more universally functional and more versatile in application and operation than known methods or devices.

Thus, one aspect of various embodiments of the present invention is to provide a water pumping station with an improved structural enclosure to prevent differential settlement, which is common with two-structure enclosures of the prior art or enclosures with footprints that vary with height. Note that the terms "enclosure," "structure," and "body" are used interchangeably herein. Differential settlement occurs when the valve vault chamber and the wet well are two separate structures of two different lengths located at two different depths. Differential settlement can also occur if the structure has a footprint that varies with height (e.g., the valve vault chamber sticks out beyond the footprint of the wet well). Differential settlement occurs because the soil is often different at different depths (e.g., more or less rocks, sand, water, etc.) and one structure often weighs more and provides more pressure (weight per area) on the soil beneath it. Accordingly, it is another aspect of the present invention to provide a water pumping station with a single-structure enclosure having a footprint that remains relatively constant with height, which eliminates differential settlement.

Another aspect of embodiments of the present invention is to provide a water pumping station that has a higher storage capacity (i.e., larger working volume or larger wet well volume for storing water) than prior art pumping stations. This can be achieved by combining the valve vault chamber and the wet well collection chamber into a single-unit of uniform length and locating the valve vault chamber in the unusable space of the wet well. The larger working volume also reduces the depth of the excavation required.

Pumping stations are often positioned below ground. Therefore, a hole must be excavated and pumping station either built into the hole or placed into the hole. Because pumping stations of the past comprised two separate structures for the wet well and the collection chamber, two holes had to be dug to accommodate each structure. Alternatively, the hole could be a step-elevation excavation with two different depths/heights to accommodate the two different heights of the two separate structures. Thus, one aspect of embodiments of the present invention is to provide a pumping station that eliminates uneven and/or multiple excavation requirements during installation of the pumping station. The unique, single-structure design also eliminates added costs for larger, step-elevation excavations because the single-structure design uses a single-tier excavation, which also provides for significantly simpler installation. Further, the single-structure design eliminates the additional backfill and support needed to properly support a second smaller structure (i.e., the separate valve vault chamber)

A further aspect of embodiments of the present invention is to reduce the size (i.e., footprint and height), depth, and difficulty of the excavation required for the pumping station. Thus, pumping stations of the present invention may only require one excavation to accommodate the single-structure pump station. The single excavation also provides significant savings in time and money.

It is one aspect of embodiments of the present invention to provide a water pump station with a smaller footprint than the prior art pumping stations. The single-structure configuration of the present invention—as compared to the conventional two-structure pumping station—can provide a reduced footprint because the valve vault chamber is located in the unusable space of the wet well collection chamber. In some embodiments, the footprint of the improved pumping station is 50% smaller than the footprint of conventional two-structure pumping stations.

An additional aspect of embodiments of the present invention is to provide a water pumping station with thinner and lighter walls than conventional pumping stations. The innovative oval-shaped design disclosed herein allows for thinner and lighter walls to be used in the pumping station. Thus, the oval design is also cheaper to manufacture than existing pumping stations that are square shaped, rectangular shaped, or that are rectangular with rounded corners. The oval-shaped design is further disclosed in U.S. patent application Ser. No. 29/479,357, filed Jan. 15, 2014, entitled "Water Pumping Station," the entire disclosure of which is incorporated by reference herein. The innovative oval-shaped design also provides for more storage volume in the bottom of the structure to store water and equipment in the wet well collection chamber and more space in the top of the structure to integrate the valve vault chamber. Additionally, removing the flat or straight ends of the pump station body removes dead zones and makes the body easier to manufacture. The oval shape of the pump station body also had unexpected results in that it is much stronger than rectangular bodies with rounded corners. Accordingly, the concrete walls of the oval-shaped body can be thinner than the walls of a rectangular body or a rectangular body with rounded corners, thus saving significant expense during manufacturing.

One aspect of embodiments of the present invention is to provide a pumping station with a reduced installation time, which results in shorter project completion schedules. Because a single structure is much faster to install than two structures that must be secured together, the pumping stations according to the present invention may be installed as a single unit of uniform depth. The single-structure pumping station is faster to install because (1) there is one structure rather than two structures, (2) two structures do not have to be fastened together using strong, flexible, expensive, and highly-engineered fastening mechanisms, (3) only one single-step excavation is needed, and (4) less backfill and support is required. Further, the required parts and components may be pre-installed in the single-unit pump station to reduce the number of parts and components installed at the jobsite. The pre-assembly also reduces the pump station installation time.

Another aspect of embodiments of the present invention is to provide a water pumping station that eliminates the need for concrete pour trucks and concrete pour forms on the jobsite during installation. Therefore, the pump station body may be constructed of pre-cast components that can be assembled on-site. Further, the components are shaped and formed before they are placed into their final location rather than being cast on-site.

Another aspect of embodiments of the present invention is to provide a pump station enclosure with an integral valve vault chamber, which is a single monolithic structure. Accordingly, the valve vault chamber is precast with the pump station body or is precast with a section of the pump station body, meaning the valve vault chamber is cast in as a part of the precast pump station body or upper section of the pump station body. Thus, the valve vault chamber is cast at the same time the pump station body or parts of the pump station body (e.g., the upper portion) are cast. Advantages of the valve vault chamber being a monolithic structure include reduced installation times, increased strength of the interconnection points between the wet well and the valve vault chamber because fasteners and anchors are not used, no seams between the valve vault chamber and the wet well, reduced manufacturing costs, and reduced installation costs.

Another aspect of embodiments of the present invention is to provide a concrete pump station enclosure with greater durability than concrete pump station enclosures of the prior art. Accordingly, the concrete of the pump station enclosure may be a more consistent mix of materials and have greater quality control than prior art devices and systems. Wet cast self-consolidating concrete ("SCC") manufactured under plant-controlled conditions and precast has tighter tolerances, is denser, has lower permeability, and has a better consistency than cast-in-place concrete. Additionally, SCC produces minimal bugholes, has high flowability, and does not segregate (i.e., it has high stability). Thus, the enclosure may be composed of wet cast SCC. A wet cast precast SCC enclosure will have fewer voids and a higher density than a dry cast precast concrete enclosure, which is used in most round manhole sections. Furthermore, ACI recommended practice 211.1 can be used when selecting proportions for concrete. In one embodiment, precast concrete enclosures composed of SCC have a 28-day compressive strength of 5000 psi. Further, concrete that will be exposed to freezing and thawing may contain air and have a water-cementitious ratio of 0.45 or less. Concrete that will not be exposed to freezing, but which is required to be leak resistant, may have a water-cementitious ratio of 0.48 or less. For corrosion protection, reinforced concrete exposed to deicer salts, brackish water, or seawater may have a water-cementitious ratio of 0.40 or less.

An additional aspect of the present disclosure is to provide a water pumping station that prevents flotation due to ground water forces without requiring surface resistance or the weight of mechanical equipment. Thus, in some embodiments of the present invention, the enclosure includes external footing extending horizontally from a lower surface of the enclosure. After the pumping station is installed, soil is backfilled around the pumping station and onto the external footing. Thus, the weight of the soil on the external footing prevents the pumping station from floating upwardly due to ground water forces.

One aspect of embodiments of the present invention is to provide a water pumping station that may be traffic-rated to accept loading from both pedestrian and vehicular traffic. Thus, the water pumping station may be capable of withstanding a live, traffic-rated load from the top of the pumping station, commonly referred to as AASHTO HS-20 or H-20. Safety grates, access covers, and other traffic-rated covers may be used on the top slab of the pump station enclosure.

It is yet another aspect of embodiments of the present invention to provide a water pumping station that avoids particulate build-up and settlement, aids in basin cleaning, and facilitates easy cleaning maintenance. Accordingly, the water pumping station body may an oval shape or arcuate ends to eliminate particulate settlement in sharp corners. In additional or alternative embodiments, the pumping station has a sloped floor to direct debris to the pump area. Additionally, the pumps can pass solids or grind debris as required. Additional debris not pumped out may be removed via suction pump cleaning, as a standard maintenance procedure.

One aspect of various embodiments of the present invention is to provide a pumping station body that is inexpensive and easy to manufacture. In one embodiment, the pumping station body is comprised of precast sections for easy installation and assembly. Thus, the standard design provides rapid engineering documents for approval and repetitious high-quality castings and equipment outfitting.

Another aspect of embodiments of the present invention is to provide a pre-packaged water pumping station to eliminate costly site labor and time-consuming site alterations. Thus, the pumping station is pre-assembled and outfitted in the factory and some embodiments of the pumping station are delivered pre-assembled from the factory. Accordingly, the pumping station can be installed in a matter of hours and backfilling can occur on the same day as installation.

One aspect of embodiments of the present invention is to provide a water pumping station that, when installed, requires less open-excavation time on a jobsite to reduce dewatering time and costs and to improve jobsite safety. The rapid installation of the pre-assembled pump station also reduces the risk of on-site injury by minimizing the amount of time that the hazardous excavation is open, which in most cases is a fraction of a day. When dewatering is a jobsite issue, this costly and tedious operation may be considerably lessened because the excavation open time is reduced. In addition, the package of interior, pre-assembled components eliminates much of the entry into the pump station's confined space, which is common in site-constructed products.

In one embodiment, a water pumping station is provided comprising a valve vault chamber with a valve vault assembly and a wet well collection chamber with submersible pumps for moving and lifting waste or storm water. In additional embodiments, the water pumping station also comprises an inlet, a discharge pipe, an outlet, float switches, a vent, and at least one access opening. Additional components may be included in additional embodiments.

In some embodiments, flange couplings are mounted on each pump base elbow to ensure proper pressure seal while providing a minimum assembly flexibility. The flange couplings can be fusion bond epoxy coated and supplied with a 304-stainless steel assembly and mounting hardware for harsh and wet environments. The pipe gasket and O-ring seal can be Nitrile (Buna N) NFS 61 listed.

In various embodiments of the present invention, a water pumping station with a wet well collection chamber and a valve vault chamber contained within a single pump station body is provided. Thus, the valve vault chamber is located in an upper, unused portion (i.e., not in the working volume) of the wet well collection chamber. Additionally, combining the wet well collection chamber and the valve vault chamber into one structure increases the working volume of the wet well because the wet well now extends to the space below the valve vault chamber. Furthermore, the single-piece pump station body decreases the required excavation depth and thus reduces the amount of excavation required.

In some embodiments of the present invention, the pump station body is a single structure with an integral monolithic valve vault chamber. Because the valve vault chamber and pump station body are monolithic, the installation and assembly time of the pump station is reduced. In alternative embodiments, the pump station body is composed of multiple sections and one section (e.g., the upper section) is precast with an integral monolithic valve vault chamber.

In one embodiment, the pump station body has an oval shape, which may be similar to a rectangular shape with rounded or arcuate ends, to maximize volume, minimize the station's footprint, eliminate particulate settlement in sharp corners, and facilitate easy cleaning. In other embodiments, the pump station body has an elongate shape with arcuate ends when viewed from a top plan view. In further embodiments, the pump station body has an oval shape, a circular shape, a square shape, a rectangular shape, or any other shape known in the art.

In one embodiment of the present invention, the pumping station a turnkey product, custom-built per the user's requests, which is supplied with all of the required equipment and services, including engineering, design assistance, and factory assembly. In an alternate embodiment, the pumping station is a stockable pump station built using stock parts.

In various embodiments, the pump station enclosure is comprised of a base with a base slab and a base riser extending upwardly from the base slab. In some embodiments, the base slab further comprises a sloped floor with the lowermost point of the slope positioned proximate to a pump. The lowermost point of the slope may also be a flat surface of the base slab. The highest point of the slope may be positioned under the wet well and against an inner surface of the bottom riser wall. The sloped floor may also extend upwardly from below the pumps to the inner surface of a planar portion of the bottom riser wall. Additionally, the sloped floor may extend upwardly from below the pumps to the inner surface of an arcuate portion of the bottom riser wall proximate the pump end of the enclosure. In yet a further embodiment, the base (also called the bottom portion of the pump station body herein) may be monolithic and precast as one piece. Existing pump stations often poured a sloped section over the base slab after the base slab was cast. Thus, the sloped section was a separate piece from the base slab. Often times the slope was poured on-site (cast-in-place) and therefore had rough surfaces. Precasting the sloped floor with the entire bottom section creates a smoother finish, which allows water and debris to flow toward the pumps more easily. Additionally, water could seep into the cracks between the base slab, bottom riser, and sloped portion and cause problems such as leakage or fracture if the water in the cracks froze.

In some embodiments, the pump station enclosure is comprised of a top slab with a top surface and one or more access openings. The access openings may include access frames, access covers, and/or safety grates. If two access openings are included in the top slab, then one access opening provides access to the valve vault chamber while the other access opening provides access to the wet well. In additional embodiments, if two or more pumps are included in the pump station, then the access opening over the wet well can be sized to allow for the removal of the two or more pumps at the same time. Because the valve vault chamber is shallower and typically only requires a man-way over a ladder, the access opening can be smaller than the access opening over the wet well.

In one embodiment, the pump station comprises one or more stackable risers. Each riser may be the same height or a different height. Each riser is the same shape and comprises a riser wall and interconnection means in order to stack and interconnect to one another such that a watertight seal can be formed. The risers may interconnect to one another, the base, or the top slab using tongue and groove structures, rubber seals similar to O-rings, or other sealing mechanisms known in the art.

In various embodiments the precast components (e.g., bottom riser, risers, upper section, and top slab, etc.) may be fabricated on steel forms with machined rings to form accurate bell and spigot joint surfaces to ensure watertightness. All horizontal joints between precast sections can be sealed with a vulcanized butyl rubber joint material conforming to AASHTO M-198 or a similar standard. Joints may also be comprised of other configurations including O-ring joints and wedge gasket joints, as well as other joints known in the art.

Providing an embodiment of a pumping station with stockable structural component and mechanical components offers standard budget and quote pricing, standard drawings and cut sheets, and quicker manufacturing assembly due to product repetition.

Various embodiments of the pump station enclosure include an upper section, which is a top riser with an inlet, an outlet, and a partition and floor section creating the integral valve vault chamber. In one embodiment, the upper surface of the upper section (i.e., upper surface of the top riser wall) includes an interconnection mechanism or sealing mechanism to interconnect the upper section to the top slab. In additional embodiments, the lower surface of the upper section includes an interconnection mechanism or sealing mechanism to interconnect the upper section to a riser.

In some embodiments, the height and depth of the valve vault chamber are adjustable. In one embodiment, 2' and/or 4' integral valve vault chamber extensions are available. In further embodiments, a 3' wet well shim or extension is also available. In alternate embodiments, the pump station body or the upper section of the pump station body can comprise a shelf upon which the valve vault chamber can be set. The shelf would be monolithic and cast in with the precast body. In some embodiments, the valve vault chamber is also precast and positioned on the shelf upon installation. Therefore, spacers or other known mechanisms could be used to place the valve vault chamber at varying heights above the shelf or directly on the shelf. Bolts and L-brackets could also be used to secure the valve vault chamber within the pump station body or on the shelf. In alternative embodiments, the pump station body does not comprise a shelf. Rather, the valve vault chamber is secured to an inner surface of the pump station body using known attachment means, such as bolts, screws, L-brackets, clamps, clips, etc. In this embodiment, the valve vault chamber may be positioned at different heights relative to the pump station body. Additionally, the valve vault chamber's volume and/or length may be varied depending on the application and specific design needs.

Embodiments of the pumping station and pump station body are versatile regarding inlet and discharge layout. The inlet(s) may enter the station anywhere around the perimeter of the pump station body. Cored openings with manhole boots are typically factory located and installed, unless the inlet opening spans becomes critically close to the structural joints. In such a case, site coring after erection is required by the site contractor. One of the three common discharge locations from the valve vault chamber may be selected or the discharge location can be moved to a custom location on the pump station body. The three common discharge locations include (1) an end opposite the inlet, (2) a side of the pump station body proximate to the end opposite the inlet, and (3) a different side of the pump station body proximate to the end opposite the inlet.

In some embodiments of the present invention, the valve vault conforms to ASTM C-478. In further embodiments, sections of the valve vault are tongue and grooved. In some embodiments, any non-precast pipe openings in the valve vault are cored and rubber boots are installed in the cored pipe openings. In various embodiments, the mechanical joint bolts, nuts, and washers used with or within the valve vault are composed of weathering steel, also known as Cor-Ten™ or corten steel. All other hexagonal bolts, nuts, and washers are composed of 304 grade stainless steel.

The water pumping station generally comprises a pump station body, a wet well collection chamber, a valve vault chamber, a valve vault assembly, an inlet, an outlet, a pump discharge line, and one or more submersible pumps. The pumping station may also include guide rails, a trash basket assembly, securing mechanisms (e.g., elbows, screws, bolts, joints, clips, U-clamps, etc.), access openings with access covers, a valve vault assembly with a check valve and a bypass valve, an access ladder, float switches or a level sensor, a control panel, a junction box, a transducer, a vent, power cables, and control cables.

The water pumping station of the present disclosure was designed with an integral valve vault chamber using advanced engineering techniques, included the finite element method, to determine stresses and minimize the materials required. Knowledge of potential loading conditions and failure modes must be taken into account and used in the design process.

In one embodiment of the present invention, a pre-packaged pumping station is provided. The pre-packaged pumping station includes pre-assembled components such as pumps, piping, wiring, and controls.

In one embodiment, a unitary, below-grade, pumping station for moving liquids comprises: a rounded corner fluid receiving container, the container comprising: a top slab; a bottom section comprising a riser section cast into a base slab resulting in a monolithic base section with the slab extending out past the riser walls a distance approximately equal to the thickness of the riser wall, the monolithic base section embodying a sloped floor that extends upward from the top surface of the base slab to the interior surface of the riser wall; and multiple riser sections, which when assembled create a generally elongated pill-shaped structure with planar vertical sides and ends, the structure comprising at least one generally rectangular access opening and at least one of an access frame and a cover.

In some embodiments, a pre-packaged, pre-assembled pump station is provided complete with one or more submersible pumps, a precast concrete pump chamber with an integral valve vault structure, a slide-rail pump removal system, discharge piping with required supports and fittings, a discharge check valve, a discharge plug valve, one or more access hatches, a valve vault access ladder, liquid level controls, a duplex pump control panel, internal wiring, and other required appurtenances.

In one embodiment, a multi-part, precast concrete enclosure for a below-grade pumping station for moving liquids is provided comprising: a top slab; an upper section comprising vertically extending sidewalls and arcuate end sections which define a perimeter shape, a valve chamber, and a water collection chamber, wherein the upper section is sealingly engaged on an upper end to a lower surface of the top slab; an inlet positioned proximate to the water collection chamber, wherein the inlet allows fluid to enter the water collection chamber; an outlet positioned proximate to the valve chamber; a precast concrete bottom section further defining the water collection chamber, the bottom section comprising: a concrete base slab with a upper surface and a perimeter edge; and a wall extending upwardly from the upper surface of the base slab, the wall comprising vertically extending sidewalls and arcuate end sections which define a perimeter shape; a sloped floor portion extending upwardly from the upper surface of the concrete base slab to an inner surface of the wall; a beveled corner section joining a portion of the inner surface of the wall to a portion of the upper surface of the concrete base slab; and wherein the bottom section is monolithic; a first access opening for access into the collection chamber; a second access opening for access into the valve chamber; wherein the bottom section and the upper section are sealingly engaged; and wherein the valve chamber is separated from the collection chamber by at least a partition wall and a valve chamber floor.

In further embodiments of the enclosure, the base slab extends outwardly from an exterior surface of the wall of the bottom section a distance approximately equal to a thickness of the wall, a lower end of the wall of the bottom section is thicker than an upper end of the wall, and the bottom section is precast of wet cast self-consolidating concrete. In some embodiments of the enclosure, the enclosure further comprises a first riser section comprising vertically extending sidewalls and arcuate end sections, wherein the first riser section is positioned between the upper section and the bottom section to selectively alter a height of the precast concrete enclosure; a second riser comprising vertically extending sidewalls and arcuate end sections, wherein an upper surface of the second riser is sealingly engaged to a lower surface of the first riser, and wherein a lower surface of the second riser is interconnected to an upper surface of the wall of the bottom section, and the first riser has a first height and the second riser has a second height, and wherein the first height is not equal to the second height. In one embodiment, the valve assembly comprises at least one of a water meter, a backflow preventer valve, and a pressure reducing valve. In various embodiments, the top slab, the first riser, and the bottom section are precast of wet cast self-consolidating concrete.

In one embodiment, a below-grade pumping station for collecting and moving liquids is provided comprising: a height-adjustable, precast concrete enclosure comprising: a top slab having a substantially planar upper surface, arcuate ends, and at least one access opening; an upper section comprising vertically extending sidewalls and arcuate end sections which define a perimeter shape, an internal valve chamber, and an internal collection chamber, wherein the upper section is interconnected on an upper end to the top slab; an inlet positioned proximate to the internal collection chamber, wherein the inlet allows fluid to enter the internal collection chamber; an outlet positioned proximate to the valve chamber; a monolithic, precast concrete bottom section further defining the internal collection chamber, the bottom section comprising: a base slab having a lower surface, an upper surface, and a perimeter edge; a substantially oval shaped perimeter wall section extending upwardly from the upper surface of the base slab and positioned within the perimeter edge, the perimeter wall section having a thicker lower section than an upper section; an interior junction between the substantially oval shaped perimeter wall section and the upper surface of the base slab; a beveled corner section extending at least partially around the interior junction; and a sloped floor section positioned proximate the upper surface of the base slab, wherein the sloped floor section extends from an arcuate end of the perimeter wall section toward an opposing arcuate end of the perimeter wall section to promote drainage of the liquid; a first pump; a discharge line; a valve assembly positioned within the internal valve chamber; at least one of a float switch and a level sensor; and a vent.

In further embodiment, the below-grade pumping station further comprises one or more intermediate riser sections comprising vertically extending sidewalls and arcuate end sections, wherein the one or more intermediate riser sections are positioned between the upper section and the bottom section to selectively alter a height of the precast concrete enclosure. In some embodiments, the monolithic bottom section is precast of wet cast self-consolidating concrete, and the valve assembly comprises a check valve. In one embodiment, the below-grade pumping station further comprises a second access opening in the top slab, wherein the second access opening provides access into the valve chamber.

In some embodiments, the precast concrete used for the pump station enclosure is wet cast SCC precast concrete manufactured under plant-controlled conditions. Further, the precast concrete may be mixed and formed using a tight tolerance of aggregate gradations, moisture contents, mix proportions, and chemical admixtures and using microwave moisture sensors in the aggregate bins and concrete mixers.

In one embodiment, the pump station with an integral valve vault chamber is delivered to the job site pre-plumbed, pre-tested, and ready for installation. In only 4 hours, the pump station can be erected, plugged-in to the main system piping, and backfilled.

In some embodiments, the pumping station has standard, stockable structural and mechanical components. The standard product design features fast turnaround time on submittals and production. Further, the pump station is factory assembled and then disassembled sufficiently for shipping. In one embodiment, only the vertical piping that crosses pre-cast joints is removed for shipment. Thus, field erection and reassembly occur in less than 4-hours.

In various embodiments, the pump station is factory assembled and shipped to the job site as follows: (1) wet well precast base assembly with interior fillet and extended base; (2) the pump base elbow and slide couplings are factory mounted; (3) precast concrete riser shims as required, include holes and factory installed rubber boots; (4) the integral valve vault assembly includes factory-installed piping, valves, supports, gauges, bypass, ladder, and drain to pump station; (5) riser sections for the valve vault chamber; (6) the precast pump station top slab with aluminum access covers; and (7) miscellaneous items are provided and field installed, including pumps, control panel, floats, vertical discharge piping, dresser couplings, and pump guide rails.

In one embodiment, a method of forming a concrete enclosure for a pumping station is provided. The method comprises precasting a bottom section comprising a base slab with an upper surface, a bottom riser, and a sloped section of the upper surface as a single monolithic piece. The bottom section is precast upside-down in a mold using wet cast SCC. Additionally, risers, valve vault risers, and top slabs (also called top portions) are precast in separate molds using wet cast SCC. An upper section comprising the valve vault is also precast in a mold. Following the initial set of the concrete in the mold and the completion of surface finishing, curing operations will commence.

According to one embodiment, a method of installing a pump station is provided. First, flat bed trucks arrive with the pump station components. Then the area is excavated so that it is ready for pump station installation. Next, a crane off-loads the base section of the pump station body into the excavation, and additional sections are set at a rate of approximately one section every thirty minutes. Then the crane sets the long discharge pipes and pump guide rails (which are shipped loosely) into the pump station. The pump station upper section with an integral valve vault chamber is then set. Next, minor reassembly of loosely shipped items is completed. Then the top slab is set on the pump station. Lastly, backfill begins.

The pump stations according various embodiments are designed with narrow dimensions to transport them, without the need for wide-load permits. Devoid of permit restrictions; site delivery schedules can usually be met without compromise. Once the station is complete and ready for shipment, a pump station company representative will contact the site contractor with specific questions and details to make delivery and site access as seamless as possible. In most cases trucking can be scheduled for early morning delivery times, and must be coordinated with the setting crane equipment through the site contractor. All factory installed equipment, unless otherwise noted, will remain in the precast sections for transport to the site. All transportation equipment and operators fully comply with insurance institute and on-site safety guidelines. Maximum standard transportation width is 8'-8"W, and maximum transportation height (on the trailer) is 11'-3"H.

In one embodiment, the pumping station features a four-point lifting configuration which utilizes four 8-ton Burke clamshell lifting toggles or the equivalent. The pump station sections may be off-loaded from the delivery truck and into the final excavation.

In one embodiment, prior to the placement of the final layer of roadway, the frames and adjusting rings located within paved areas are set in an IDOT approved concrete "SI" mixture.

In one embodiment, a method of installing a below-grade pumping station for collecting and moving liquids is provided comprising: providing an enclosure comprising: a top slab; an upper section comprising vertically extending sidewalls and arcuate end sections which define a perimeter shape, an interior valve chamber, and a collection chamber for receiving fluids; a first riser; a second riser; a monolithic, precast concrete bottom section further defining the collection chamber, the bottom section comprising: a base slab having a lower surface, an upper surface, and a perimeter edge; a substantially oval shaped perimeter wall section extending upwardly from the upper surface of the base slab and positioned within the perimeter edge; an interior junction between the substantially oval shaped perimeter wall section and the upper surface of the base slab; a beveled corner section extending at least partially around the interior junction; and a sloped floor section positioned proximate the upper surface of the base slab, wherein the sloped floor section extends from an arcuate end of the perimeter wall section toward an opposing arcuate end of the perimeter wall section; excavating a hole of uniform depth; inserting the bottom section into the hole; stacking the second riser on the bottom section; interconnecting the second riser to the bottom section; stacking the first riser on the second riser; interconnecting the first riser to the second riser; inserting a discharge pipe into the enclosure; stacking the upper section on the first riser; interconnecting the first riser to the upper section; inserting at least one pump into the enclosure; interconnecting the top slab to the upper section; and back-filling the hole.

In further embodiments, the method of installing a below-grade pumping station further comprises at least one of inserting a pump guide rail into the enclosure and interconnecting a vent to the enclosure. Alternatively, the method further comprises assembling the enclosure, the discharge pipe, the pump, an inlet, an outlet, and a valve assembly; disassembling the enclosure, the discharge pipe, the pump, an inlet, an outlet, and a valve assembly; and wherein, the assembling and the disassembling occurs before excavating the hole. In one embodiment, the method of installing a below-grade pumping station further comprises, before inserting the discharge pipe into the enclosure, stacking a third riser on the first riser; and interconnecting the third riser to the first riser. In various embodiments, the method of installing a below-grade pumping station, further comprises interconnecting an outlet of the pumping station to an outlet pipe; and interconnecting an inlet of the pumping station to an inlet pipe.

The phrases "at least one", "one or more", and "and/or", as used herein, are open-ended expressions that are both conjunctive and disjunctive in operation. For example, each of the expressions "at least one of A, B, and C", "at least one of A, B, or C", "one or more of A, B, and C", "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification, drawings, and claims are to be understood as being modified in all instances by the term "about."

The term "a" or "an" entity, as used herein, refers to one or more of that entity. As such, the terms "a" (or "an"), "one or more" and "at least one" can be used interchangeably herein.

The use of "including," "comprising," or "having," and variations thereof, is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts, and the equivalents thereof, shall include all those described in the summary of the invention, brief description of the drawings, detailed description, abstract, and claims themselves.

These and other advantages will be apparent from the disclosure of the invention(s) contained herein. The above-described embodiments, objectives, and configurations are neither complete nor exhaustive. The Summary of the Invention is neither intended nor should it be construed as being representative of the full extent and scope of the present disclosure. Moreover, references made herein to "the present invention" or aspects thereof should be understood to mean certain embodiments of the present disclosure and should not necessarily be construed as limiting all embodiments to a particular description. The present disclosure is set forth in various levels of detail in the Summary of the Invention as well as in the attached drawings and Detailed Description and no limitation as to the scope of the present disclosure is intended by either the inclusion or non-inclusion of elements, components, etc. in this Summary of the Invention. Additional aspects of the present disclosure will become more readily apparent from the Detailed Description, particularly when taken together with the drawings.

BRIEF DESCRIPTION OF THE DRAWINGS

The accompanying drawings, which are incorporated in and constitute a part of the specification, illustrate embodiments of the disclosure and together with the general description given above and the detailed description of the drawings given below, serve to explain the principles of these embodiments.

Figure 1:
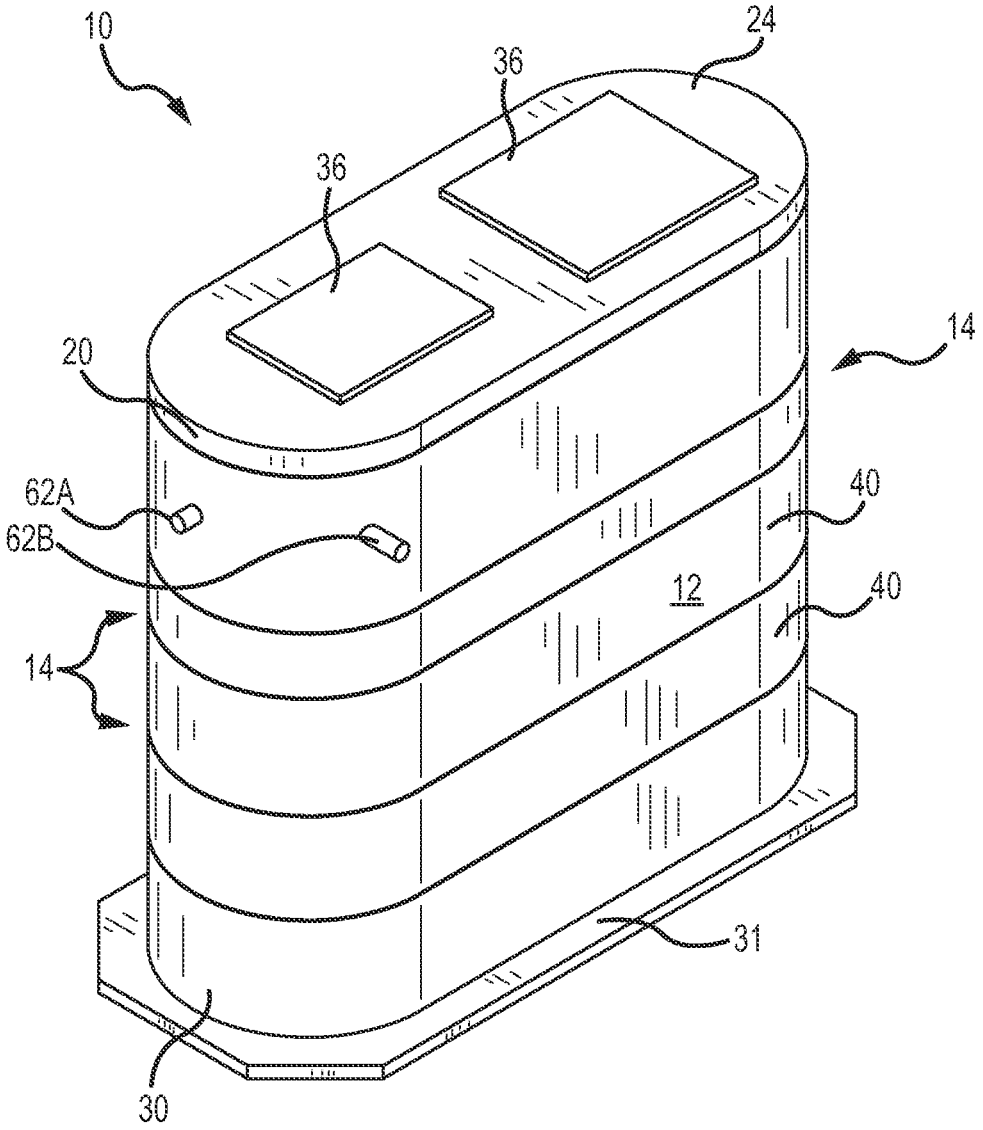
FIG. 1 is a rear perspective view of an embodiment of a pump station body.

To assist in the understanding of the embodiments of the present invention the following list of components and associated numbering found in the drawings is provided herein:

| Component No. | Component |
|---|---|
| 2 | pumping station |
| 4A-F | float switches |
| 6 | collection chamber (wet well) |
| 10 | pump station body |
| 12 | vertical side (of pump station body) |
| 14 | end (of pump station body) |
| 16 | valve vault chamber |
| 18 | valve vault assembly |
| 20 | top slab (of pump station body) |
| 22 | pump |
| 24 | top surface |
| 26 | bottom surface (of top slab) |
| 28 | thickness (of top slab) |
| 30 | base (of pump station body) |
| 31 | base slab |
| 32 | access opening |
| 34 | access frame |
| 36 | access cover |
| 36A | grate (access cover) |
| 38 | perimeter wall |
| 40 | riser (of pump station body) |
| 40A | bottom riser (of base) |
| 42 | sloped floor |
| 44 | access ladder (into valve vault) |

-continued

| Component No. | Component |
|---|---|
| 46 | upper section (of pump station body) |
| 48 | beveled corner section |
| 50 | wall (of riser) |
| 52 | inlet |
| 54 | control panel |
| 56 | vent |
| 58 | inner surface (of riser) |
| 58A | inner surface (of base riser) |
| 60 | junction box |
| 62 | outlet |
| 62A | outlet - optional location A |
| 62B | outlet - optional location B |
| 64 | bypass valve |
| 66 | transducer |
| 68 | valve vault floor drain |
| 70 | guide rails |
| 72 | pump discharge line |
| 74 | pump power wire |
| 76 | pump control wire |
| 78 | sealing section |
| 80 | interconnection point |
| 82 | trash basket assembly |
| 84 | vertical partition wall |
| 86 | horizontal partition wall (valve chamber floor) |

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Although the following text sets forth a detailed description of numerous different embodiments, it should be understood that the legal scope of the description is defined by the words of the claims set forth at the end of this disclosure. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. Also note that the scale for each figure is different. Thus, the scale for FIG. 1 is different from the scale of FIG. 2, etc.

Figure 2:
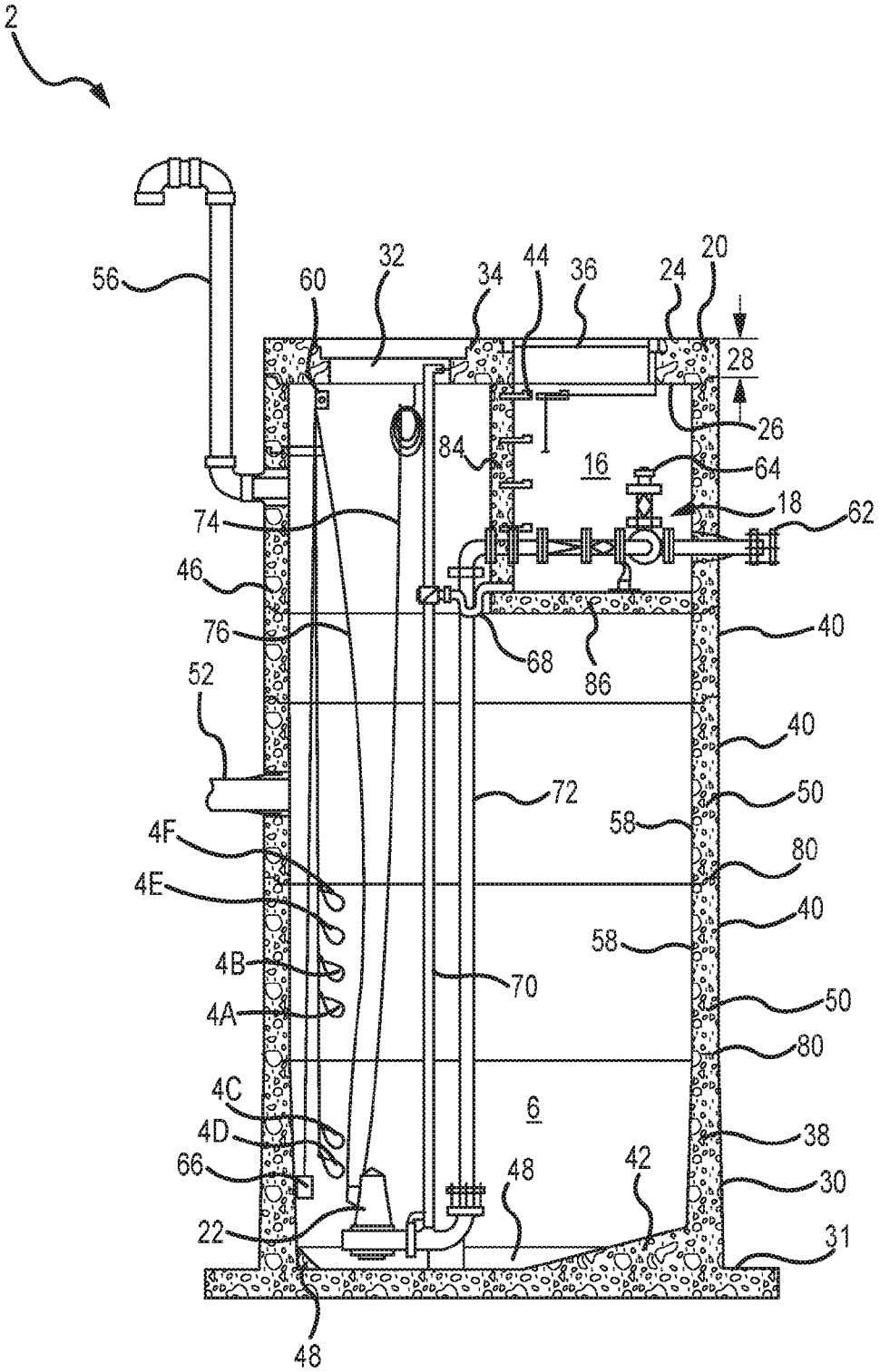
FIG. 2 is a cross-sectional front elevation view of an embodiment of a water pumping station.

FIG. 1 shows one embodiment of a pump station body. In the embodiment shown, the pump station body 10 comprises a top slab 20, a top surface 24, outlets 62A, 62B, two access covers 36, risers 40, a base 30, and a base slab 31. Two optional locations for an outlet 62 are shown in FIG. 2: optional location A for the outlet 62A and optional location B for the outlet 62B, both of which are positioned proximate to the valve vault chamber. Typically, only one outlet 62A or 62B will used in a pumping station. However, more than one outlet 62A, 62B is possible in alternative embodiments. Additionally, some embodiments may include and overflow outlet and line to the main pumping system or to an overflow tank. An overflow outlet and line will typically be positioned such that water can exit the wet well if both pumps fail or if both pumps cannot hand the incoming water load. Thus, the overflow outlet will be positioned in the wet well collection chamber. The risers 40, when assembled, create a generally elongated shaped structure with planar vertical sides 12 and arcuate ends 14. The pump station body may, in alternate embodiments, have an elongated pill shape. Thus, the one or more risers 40 are generally oval shaped. In another embodiment, the risers 40 are rectangular in shape having rounded corners, resulting in a generally pill-shaped riser 40. In still further embodiments, the pump station body 10 may be manufactured in a variety of shapes, including but not limited to a parallelogram, rectangle, rhombus, square, trapezoid, cylinder, sphere, or box. In various embodiments, no matter the shape of the structure 10, each riser 40 has a continuous vertical planar wall 50 to form a ring with a wall height and thickness. The riser wall height is typically greater than 6" and the riser wall thickness is typically greater than 4". In some embodiments, the riser wall height is at least one of 6", 1', 2', 3', and 4'. In various embodiments, the wall thickness is at least one of 4", 5", 6", 7", 8" or 9".

In one embodiment, the pump station body 10 is manufactured from precast concrete. In an additional embodiment, the pump station body 10 is constructed with precast, reinforced concrete sections. In other embodiments, other materials may be used to manufacture the pump station body 10 including but not limited to plastic, polymer concrete, other materials known in the art. In additional embodiments, the pump station body 10 is manufactured of materials and composition mixes having various combinations of ingredients such as those found in the manufacture of concrete, plastics, polymers, cement, water, cementitious materials, chemical and/or mineral admixtures, and coloring agents, which when combined may create the concrete material. Various embodiments may include a wide variety of different finishes, colors, and textures, such as those commonly utilized in the architectural and stone industries.

In one embodiment, an antimicrobial admixture may be added to the concrete mix to prevent the formation of hydrogen sulfide gas. In additional or alternative embodiments, other added mixtures such as waterproofing materials (e.g., a crystalline waterproofing additive, such as XYPEX® Admix C-1000 manufactured by XYPEX® Chemical Corporation) are used to seal the concrete against the penetration of liquids from any direction and protect the concrete from deterioration due to harsh environmental conditions. Although the pumping station is designed for water-tightness without exterior coatings or additives, additional coatings may be applied to either internal or external surfaces in some embodiments. For example, Karnak #83 AF fibered damp proofing asphalt compound can be applied to the pump station body at the rate of about 25 sf/gal.

In some embodiments, the structures are designed to prevent flotation without requiring surface resistance (skin friction) or the weight of mechanical equipment when the ground water level is at finished ground surface. The factor of safety against uplift is calculated as a ratio of the total resisting force (excluding skin friction and the weight of the equipment) to the total hydrostatic uplift force, and may be at least 1.15 in some embodiments. The net uplift force may be transferred to the anti-buoyancy collar.

In one embodiment, all pump station 2 exterior walls below finished grade can be designed for a fluid pressure of 90 psf per foot of depth caused by saturated earth pressure. The top of the pressure diagram is assumed to originate at finished grade. In addition to the soil pressure, a two-foot live load surcharge shall be applied to a depth of eight feet.

FIG. 2 shows one embodiment of a water pumping station 2 with an integral valve vault 16. Specifically, FIG. 2 shows the internal components of the pumping station 2. The water pumping station 2 generally comprises a pump station body, a wet well collection chamber 6, a valve vault chamber 16, a valve vault assembly 18, an inlet 52, an outlet 62 (which is shown in position 62A per FIG. 1), a pump discharge line 72, and one or more submersible pumps 22. Additionally, the system design flow rate may determine the interior piping size, valve size, and force main size.

In some embodiments, piping and fittings are ductile iron, polyvinyl chloride (PVC), or galvanized steel pipe. In one embodiment, piping and fittings supplied with the pumping station are ductile iron class 53. The standard pipe and fittings may be cement lined to the thickness as specified ANSI A26.51 and ANSI A21.4 and may be interior and/or exterior asphalt seal coated by the pipe manufacturer. In one embodiment, the piping and fittings are factory coal-tar epoxy coated. In one embodiment, the piping and fittings are factory epoxy Hi-Build Epoxoline (Tnemec N-69) coated.

In some embodiments, the structural design calculations for the pumping station 2 with an integral valve vault chamber 16 may be prepared and stamped by a registered professional engineer in the project state, and may be submitted for approval prior to fabrication or for record purposes as project time allows. The structural design may take into account discontinuities in the structure produced by the openings for the inlet 52, outlet 62, vent 56, and access opening(s) 32. In one embodiment, the access opening is 30"×48". In another embodiment, the access opening is 36"×54". In a further embodiment, the access opening is 30"×36".

In various embodiments, all pipe penetrations for the water pumping station 2 may utilize cored openings with flexible manhole boots and stainless strap anchors. Pipe penetrations may include: inlet(s) 52, discharge piping 72 from pumps 22 and common discharge exiting the station, and station venting 56. These pipe penetrations may be cast in during manufacturing.

Some embodiments of the piping station 2 include vertical discharge piping 72 from the pump base elbows. This discharge piping can be additionally supported to the wet well 6 structure in intermediate locations utilizing stainless steel structural angles and stainless steel U-bolts, especially when the pump station height exceeds 15 feet.

Typical embodiments include two pumps 22, but the second pump is not viewable in FIG. 2 because it is positioned behind the first pump 22. In some embodiments, the pumping station 2 may have one, two, three, or more pumps 22. If the pumping station 2 has two or more pumps 22, then the pumps may either be arranged in parallel such that the second pump has a higher flow with equal head (i.e., head or lifting force) to the first pump. Otherwise, the pumps 22 could be arranged in series such that the two or more pumps have the same amount of flow, but one pump will have a larger amount of head.

Critical pumping station elevations include "Top Of Structure" (TOS), grade elevation (also called finished grade elevation because it is the height or level of the ground surrounding the pump station after surrounding ground is set in its final position), inlet invert elevation, floor elevation of structure, and discharge elevation. TOS is usually set at grade elevation or at least 6" above grade elevation.

The inlet invert elevation is site-dependent and is determined from the slope of the pipe coming into the pumping station. Determining the pumping station inlet location is a critical part of the design. The elevation above the inlet is unusable space. A portion of the pump station space below the inlet invert is the "working volume" of the pumping station 2 and, as such, sets the minimum depth of the pumping station 2. The floor elevation for the pumping station 2 and the pumping station's total height is determined by the lowest inlet invert elevation, the system's reserve and working volumes, and the TOS. Once the inlet invert elevation is determined, reserve and working volumes are determined based on the volume per foot values for the pumping station. Then a minimum floor elevation of the pumping station 2 can be calculated. The pumping station discharge elevation is usually a minimum of four feet below grade, even when the TOS is set 6" above grade. Should a deeper discharge elevation be required, optional risers 40 (which are two feet or four feet tall in some embodiments) can be added to produce additional earth cover.

The pump station body comprises a top slab 20, multiple risers 40 (each with a riser wall 50 having an inner surface 58), and a base 30 having a slab 31 and a perimeter wall 38, which can also be an oval-shaped bottom riser. The top slab 20 of the pump station body has a top surface 24, a bottom surface 26, and a thickness 28. In one embodiment, the pump station body also comprises a sloped floor 42, which is sloped toward the pump(s) 22 such that water and debris are directed toward the pump(s) 22. In some embodiments, the perimeter wall 38 of the base 30 is not positioned on the perimeter of the base slab 31. Therefore, a section of the base slab 31 extends outwardly in a horizontal direction from the perimeter wall 38. This outwardly extending section, which may be called a lip herein, prevents floatation of the pumping station because the soil backfilled around the pumping station will provide a downward force on the lip. In some embodiments, the base 30 is monolithic, precast concrete and includes a sloped floor 42 and a beveled corner 48 positioned between the base slab 31 and an inner surface of the perimeter wall 38. The sloped floor 42 and beveled corner section 48 promote drainage of the water and debris to the pumps.

In some embodiments, the valve vault chamber 16 is precast with the pump station body or is precast with a section of the pump station body, meaning the valve vault chamber 16 is cast in as a part of the precast pump station body or upper section 46 of the pump station body. In various embodiments, the valve vault chamber 16 is formed by a substantially vertical partition wall 84 and a substantially horizontal partition wall (also called the valve vault chamber floor) 86. In one embodiment, the wet well 6 is also cast in as a part of the pump station body. In alternate embodiments, the wet well 6 is formed from multiple sections, e.g., the base 30, base slab 31, bottom riser, one or more risers 40, an upper section 46, and a top slab 20.

In some embodiments, the pumping station 2 further comprises a vent 56, guide rails 70 for the pump(s) 22 to slide down and up for insert and removal, and one or more access openings 32. Each access opening can have an access frame 34 and/or an access cover 36. The pump 22 is designed to slide down and up the guide rails 70. When inserting the pump 22, the pump is slid down the guide rails 70 and positioned such that the pump 22 sits on the base elbows, which are anchored to the base slab 31 of the pump station. The weight of the pump 22 against the seal on the base elbow and the pressure from the pump pushing water through the discharge line 72 provides the required water-tight connection between the pump 22 and the discharge line 72. When a pump 22 needs servicing, the pump 22 is lifted, via a lifting chain or cable, off of the base elbow, up the guide rail 72 system, and out of the pump station 2 through the access opening 32. In one embodiment the base elbow is bolted to the discharge line 72. The base elbow and discharge line 72 remain in the pump station 2 when the pump 22 is removed for servicing.

In one embodiment, the pumping station includes a passive wet well vent assembly 56. The vent assembly 56 can be a standard four-inch vent fashioned from Sch80 PVC piping and fittings. Alternatively, the vent 56 can be a PVC pipe with a curved end to allow air to exit the pump station 2 such that a backpressure is not created because a backpressure would inhibit water from entering the pump station 2. In one embodiment, the vent assembly 56 ends with a gooseneck downward tuning outlet and stainless steel insect screen, positioned approximately three feet above the TOS elevation. The vent assembly 56 may be factory assembled and side-mounted to the exterior of the pump station body 10, then removed and shipped separately to the job site for field installation. If vent piping runs underground elsewhere on the site, the pump station body 10 may have a cored opening with a manhole boot positioned below grade, rather than the vent assembly 56 shown, for use when site-venting is installed. In one embodiment, the vent assembly 56 includes a 4" carbon canister with carbon refill rather than the gooseneck and insect screen.

The interior of a sewage pumping station is a dangerous place. Poisonous gases, such as methane and hydrogen sulfide, can accumulate in the wet well. Any entry into the wet well requires the correct confined space entry method for a hazardous environment. To minimize the need for entry, the pumping station 2 is normally designed to allow pumps and other equipment to be removed from outside the wet well 6. Thus, in various embodiments, the pumping station 2 may be supplied with stainless steel pump-removal guide-rail systems. The guide rails 70, which are appropriately sized for the pumps 22 of the pumping station 2 (i.e., ¾" to 2" diameter), extend from the pump base elbows to the stainless steel upper guide brackets in the hatchway area. The guide rails 70 may be composed of 304 grade stainless steel, schedule 40. The guide rails 70 may be supported at intermediate locations with stainless steel brackets, as dictated by the pump manufacturer. The pump guide-rail system is designed to easily allow the submersible pumps 22 to be removed from the pumping station 2 via a lifting chain or cable located at grade elevation and allow all pump service to be performed from outside of the pumping station 2.

In one embodiment, the discharge gauge assembly option may be selected for factory installation of a pressure discharge gauge and related accessories on each pump discharge line 72 as the pipe 72 enters the valve vault (set of two gauges total). The discharge pressure gauges allow the owner to accurately assess down-stream force main pressure conditions and test pumping conditions with select discharge isolation valves. In one embodiment, the discharge gauge assembly comprises a discharge pipe saddle, ½" brass piping and isolation or bleed-off ball valves, a gauge seal fitting, and a liquid-filled pressure gauge with a 0-30 psi, 60 psi, or 100 psi gauge-range readout, depending on the pump and system requirements.

In some embodiments, the valve vault chamber 16 houses a valve vault assembly 18. The valve vault assembly 18 may include a bypass valve 64. Further, the valve vault chamber can comprise a floor drain 68 to allow water in the valve vault to drain to the wet well 6. In additional embodiments, the pumping station 2 includes adjustable, floor-mounted, galvanized pipe stands, which support piping in the center of the valve vault chamber 16. In one embodiment, standard aluminum wall-mounted support brackets with stainless steel U-bolts may be supplied in three locations where the piping penetrations enter and exit the valve vault chamber 16. In an alternate embodiment, stainless steel floor-mounted supports are used.

3", 4", and 6" pump isolation plug valves with non-lubricated eccentric type plugs may be used in one embodiment and provide a minimum port opening of 80% in order to assure minimum turbulence and minimum pressure drop. Valves may be rated for 175 psi working pressure and cast of ASTM A126 Class B cast iron. Valve flanges meet ANSI B16.1, Class 125 flange specifications. Valves may have a balanced plug, coated with Buna-N (Neoprene) resilient seating surfaces to mate with the body seat. All plug valves may be supplied with lever operators and may be epoxy coated as supplied by the valve manufacturer.

The pumping station according to one embodiment has at least one 3", 4", or 6" check valve. The check valve may be a full-opening swing type check valve with an all-iron body and a bronze seat. The check valve may also have a resilient disc. The check valve should comply with AWWA Standard C-508 and the flanges should meet ANSI B16.1, Class 125 flange specifications. The check valve may be supplied with adjustable outside lever and weight (L&W), epoxy coated, and a standard color or materials, as supplied by the valve manufacturer. In one embodiment, the lever and air cushion check valves with L&W are used.

The pump station body 10 comprises a top slab 20, a base 30, and one or more riser portions 40. The top slab 20, which may be oval shaped, may comprise a generally planar horizontal top surface 24 and a bottom surface 26 with a thickness 28 of approximately 4" to 9", one or more generally rectangular access openings 32, one or more access frames 34, and one or more access covers 36. Alternatively, the top slab 20 may be rectangular in shape and have rounded corners, resulting in a generally pill-shaped top slab 20 when viewed from the top.

In one embodiment, the pumping station 2 comprises a valve vault access ladder 44, which can be aluminum, wall-mounted, and/or properly sized to meet OSHA Standard 1910.27. In an additional embodiment, the pumping station 2 also comprises an aluminum ladder-up, access-assist assembly.

In some embodiments, the base 30 comprises a riser section cast into a base slab 31 resulting in a monolithic base 30 with the slab 31 extending out past the riser walls 50. In one embodiment, the slab 31 extends outwardly beyond the riser walls 50 a distance approximately equal to the thickness of the riser walls 50. The monolithic base 30 further embodies a sloped floor that extends upward from the top surface of the base slab 31 to the interior surface of the riser wall 50 at an angle, thereby creating a non-horizontal floor. In some embodiments, the pump station body 10 is constructed with a reinforced concrete slab 31.

In one embodiment, the pumping station 2 comprises one or more float switches 4A-F on a bundle of wires. Alternatively, a level sensor (not shown) may be used rather than multiple float switches. The level sensor is known in the art and perform a similar function as the float switches. When the wet well collection chamber 6 fills with water and the water reaches a level equal to or above float switch 4A, the float switch sends a signal to the control panel (shown in FIG. 3) that the lead pump 22 should now be turned on. If the water continues to rise above float switch 4A to float switch 4B, then float switch 4B sends a signal to the control panel that the lag pump (not visible in FIG. 2) should now turn on. Under normal conditions, the lead and lag pumps 22 will pump water through the discharge line 72 and out the outlet 62. Thus, the water level in the wet well 6 will decrease. When the water level decreases below float switch 4C, float switch 4C sends a signal to the control panel that one of the pumps 22 can now be turned off. As the water level continues to decrease and falls below float switch 4D, float switch 4D sends a signal to the control panel that the second pump 22 should now be turned off. If the water level ever rises above float switch 4E, then float switch 4E (also called the high level alarm float) sends a signal to the control panel that the high water alarm should be sounded to notify a worker that the water has risen above a normal working level. If the water continues to rise and rises to float switch 4F, then float switch 4F (also called the high high level alarm float) sends a signal to the control panel that the high high water alarm should be sounded.

In some embodiments, the high water alarm float 4E and the high high level alarm float 4F eliminates the requirement that an overflow outlet and line be included in the pump station. Crews are often on alert with portable pumping equipment if the pumps cannot handle the water load or if either the high water alarm sounds or the high high water alarm sounds. In further embodiments, a bypass valve 64 and piping may be utilized when both submersible pumps 22 are out of commission at the same time. Thus, temporary portable bypass piping equipment, including portable pumps, could be employed to collect water from the pumping station working volume area and discharge the water through the bypass valve 64 and into the dedicated bypass force main. The bypass piping size and material options include: 2" PVC, 3" PVC, 3" ductile iron (DI), and 4" DI. This scenario, although unlikely, may also be required by the local municipal authority for back-up emergencies.

In embodiments where a level transducer 66 is used, a cable runs uncut to the control panel and no junction box 60 is required. Available site power (voltage and phase) is critical information required for pump and control selection.

In some embodiments, the pumping station 2 includes an interior junction box 60 for the pump power cables 74 and pump control cables 76 and the level control float cables. The control panel is typically remote-mounted elsewhere, such as adjacent to the pumping station 2 or within a nearby weatherproof structure or facility. The conduits and conductors between the pump control panel and the junction box 60 inside the pumping station 2 may be field supplied and installed by third parties. In one embodiment, the pump power and control cable junction box 60 is Nema 7 explosion-proof and the float cable box (not shown) is polypropylene because it is intrinsically safe. In one embodiment, the interior junction box 60 includes an RGS conduit and stainless steel supports.

In some embodiments, the pumping station may be offered with an exterior junction box (not shown), for example, the Nema 4X, with a divided interior for power and control voltages. The junction box may be mounted to the exterior of the pumping station 2 approximately two feet above TOS. The conduits and conductors between the pump control panel and the exterior junction box may be field supplied. A junction box, RGS conduit and seal-offs between the junction box and station, and stainless steel supports may be supplied in some embodiments. When a level transducer 66 is used, the cable runs uncut to the control panel and may not be routed through the exterior junction box.

In other embodiments, pump station junction boxes are not used and pump cables run uncut to the control panel, no matter the location of the pump control panel. In these embodiments, float junction boxes 66 are usually required. An intrinsically safe float junction box 66, RGS conduit, and stainless steel supports may also be used.

In embodiments where a transducer 66 is required for primary control, the transducer cable and each float cable may be suspended individually from supports inside the hatchway for easy access. In one embodiment, four or five float switches operate with stainless steel chain tree and weight assemblies. In an additional embodiment, a primary level transducer 66 with a two-float emergency back-up is used. In an alternate embodiment, a primary level transducer 66 with four or five float switches 4A-F for secondary operation are used. In some embodiments, float switches 4A-F and transducers 66 may be supplied with the pump control panel, and as such, site mounting and wiring is expected to be performed.

In various embodiments, the pump control panel is supplied with float switches 4A-4F, a submersible transducer 66, or a combination of both. The float switches 4A-F are level control devices and operation is dictated by the owner and/or local rules. When multiple float switches 4A-F for primary operation are required (four to six float switches), the pump station body 10 can include a stainless steel chain tree and weight assembly for standard float switch positioning. The stainless steel chain and weight assembly with attached floats may hang from a support in the hatchway for easy access and removal for adjustment outside of the pumping station 2.

The pumping station 2 disclosed herein allows for a variety of piping, valve sizing, and materials. Examples of piping, valve sizing, and material varieties include: (1) 2" PVC piping and valves to 2" PVC common force main (FM) discharge; (2) 3" PVC piping and valves to 3" PVC common FM discharge; (3) 3" ductile iron (DI) discharge piping and valves to 3" DI common FM discharge; (4) 4" DI discharge piping and valves to 4" DI common FM discharge; and (5) 6" DI discharge piping and valves to 6" DI common FM discharge.

Various dimensions of the pump station body are used according to various embodiments. For example, the interior width of the pump station body can be between about 4' and 7', or more specifically between about 5' and 6'. In additional embodiments, the interior width is either about 5' or 6'. The interior width is the distance between the inner surfaces 58 of the two vertical walls 12. Additionally, the interior length of the pump station body can be between about 8' and 12', or more specifically between about 9' and 11'. In additional embodiments, the interior length is either about 9' or 11'. The interior length is the distance between the inner surfaces 58 of the two ends 14. The height of the pump station body can be between about 10' and 25', or more specifically between about 10'-10" and 24'-10". In additional embodiments, the height is either about 10'-10", 12'-10", 14'-10", 16'10", 18'-10", 20'-10", 22'-10" or 24'-10". The height of the pump station body is the distance from the top surface of the base slab 31 to the T.O.S. In some embodiments, the thickness of the pump station body walls is between about 6" and 10", and more specifically between about 7" and 9". In additional embodiments, the wall thickness is either about 7" or 9". In some embodiments, the valve vault chamber 16 walls (floor and partition wall) are 3" to 8" thick. In a preferred embodiment, the valve vault chamber partition wall is about 4" thick and the valve vault chamber floor is about 6" thick at the end interconnected to the body's 10 exterior wall and the floor tapers to between 4" and 5" thick at the point interconnected to the partition wall. The valve vault chamber floor may taper and slope toward the valve vault floor drain such that water will flow toward the drain 68. In further embodiments, the thickness of the base slab 31 is the same as the body wall thickness. In other embodiments, the base slab 31 is a different thickness, for example 8" thick. In some embodiments, the thickness 28 of the pump station body top slab 20 is between about 10" and 14", and more specifically about 12". Pumping stations 2 are available in a variety of configurations including dry pit sewage stations, round submersible stations, and innovative oval-shaped stations. Pumping stations 2 according to the present disclosure and according to the dimensions given above typically replace conventional pump stations having a 6' diameter, an 8' diameter, and a 10' diameter.

Because the dimensions of the pump station body are variable in various embodiments, the volume of the pump station body varies with varying embodiments. In one embodiment, the volume of the pump station body (measured in gal/vertical foot) is between about 250 gallons and 500 gallons. In a preferred embodiment, the volume of the pump station body (measured in gal/vertical foot) is between about 295 gallons and 470 gallons. In a more preferred embodiment, the volume of the pump station body (measured in gal/vertical foot) is either 297 gal., 310 gal., 436 gal., or 466 gal.

Figure 3:
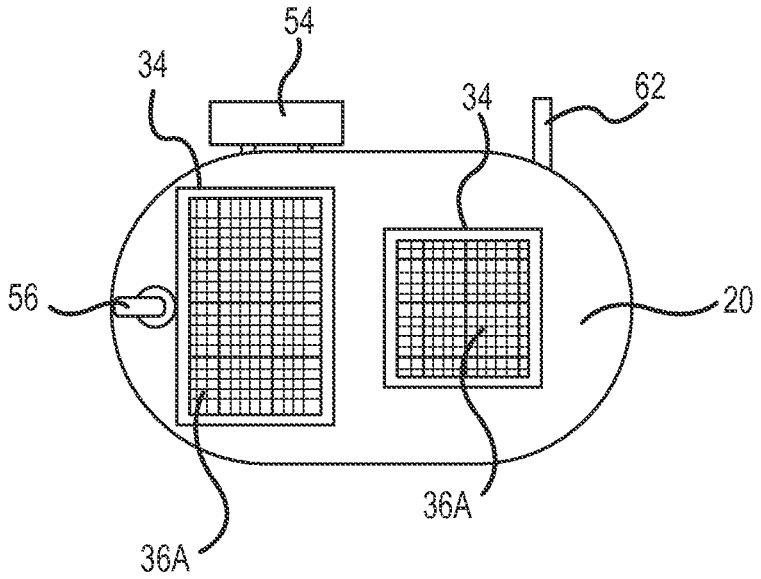
FIG. 3 is a top plan view of an embodiment of a water pumping station.

FIG. 3 shows an embodiment of a pumping station from a top plan view. The pumping station includes one or more access covers, which are hatch covers 36A in the embodiment shown, with embedded frames 34, a top slab 20, an outlet 62, a vent 56, and a control panel 54. The hatch covers 36 may be of safety grates 36A in one embodiment. The access covers may be manufactured in a variety of shapes (e.g., circular, square, etc.) and sizes to meet application needs. In one embodiment, the pump station access cover and hatch loading is 300 lb pedestrian loading or AASHTO H-20 or HS-20 vehicle loading. When TOS is set at grade elevation, the H-20 and HS-20 structural loading and hatches should be strongly considered, especially if accidental vehicle wheel loading can be foreseen. Typically, when the TOS is set 6" above grade, 300 lb pedestrian structural loading and hatches may be utilized.

In one embodiment, access hatches 36 for the water pumping station may be manufactured from a variety of materials, for example, metals (such as aluminum, steel, stainless steel, copper, or iron), plastics, polymers, and other materials known in the art.

In some embodiments, the access cover or hatch 36 on the wet well 6 side of the pumping station is equipped with an angle frame 34 and skit to full precast cover height. In one embodiment, the frame 34 is tar coated where the aluminum comes in contact with the precast concrete. In an additional embodiment, the access cover 36 comprise a slam lock and removable key operator, a recessed padlock hasp, a lift assist, and an OSHA safety grate 36A that is permanently attached to the hatchway inner frame 34. The safety grate 36A is hinged and lockable.

In other embodiments, the valve vault access opening 32 is aluminum and includes a single door, flush with precast cover, with stainless steel hardware. The access cover 36 can be a ¼" diamond plate with a stainless steel slam lock and weather plug, a lift handle that sits flush with cover, a recessed pad lock clip (pad lock by others), a hold open arm to lock cover 36 in 90-degree position, and heavy duty stainless hinges. The access frame 34 can be a channel style with 1½" NPT drain port in the bottom of the channel, a continuous 1½" anchor flange, and a full slab-height skirt to show no exposed concrete when the opening 32 is open. The access frame's 34 exterior surfaces in contact with concrete can have one coat of bituminous paint. The access opening 32 can be supplied with a heavy duty, stainless steel pneu-spring, for ease of operation when opening the cover 36.

In some embodiments, the access cover or hatch 36 on the valve vault 16 side of the pumping station 2 is equipped with a channel frame 34 and skit to full precast cover height. In one embodiment, the frame 34 is tar coated where the aluminum comes in contact with the precast concrete. The frame 34 may also comprise a slam lock and removable key operator, a recessed padlock hasp, and a lift assist.

In one embodiment, the precast pumping station is designed to support its own weight as well as at least one superimposed load selected from the group comprising a top slab, a top slab 20, a live load (AASHTO H-20 and/or HS-20), a base slab 31, live load of 200 psf, exterior walls (vertical and lateral earth loads), and the water table load due to the water table depth. All exterior walls of the pumping station that are below finished grade can be designed for an equivalent fluid pressure of 90 psf caused by saturated earth pressure. The top of the pressure diagram is assumed to originate at finished grade. In addition to the soil pressure, a live load traffic surcharge shall be applied according to the AASHTO specification. In additional embodiments, all additional equipment is accounted for in the design of the elements.

In some embodiments, the pump control panel 54 is mounted to the exterior of the pump station body at approximately two feet to six inches above TOS. The connecting RGS conduit, external seal-off fittings, and stainless steel unistrut framework support between the control panel 54 and the pumping station are also included in one embodiment.

In some embodiments, the control panel 54 is mounted and wired to the pump station. In one embodiment, the control panel 54 is shipped mounted to the pump station. In another embodiment, after factory mounting of the pump control panel 54 to the pump station body and conduit work, the control panel 54 and supports and conduit may be disassembled at the conduit unions and at the support-mounting locations such that the control panel 54 can be shipped separately, due to trucking height restrictions. Thus, the control panel 54 is shipped loose for mounting onto the pump station upon delivery or on-site and minimal reassembly effort will be required on-site. Final wiring and filling of conduit seals (pumps to control panel and level devices to control panel) are performed on-site.

Figure 4:
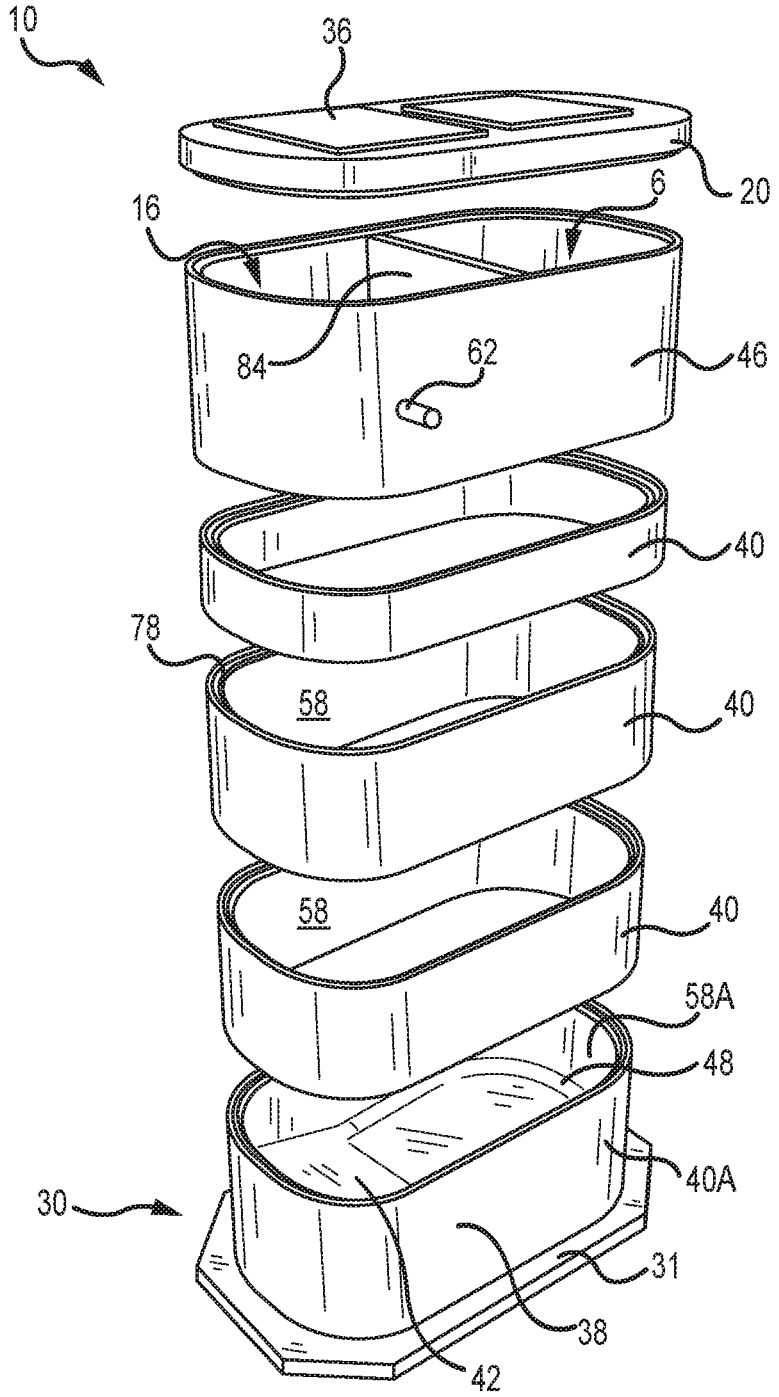
FIG. 4 is an exploded rear perspective view of an embodiment of a water pumping station comprised of multiple sections.

FIG. 4 is an exploded perspective view of an embodiment of a body for a water pumping station comprised of multiple sections. The pump station body comprises a top slab 20; one or more access covers 36; an upper section 46 with a valve vault chamber 16, the top of the wet well chamber 6, and an outlet 62; one or more risers 40 with inner surfaces 58; a base 30 with a base slab 31; a bottom riser 40A having a perimeter wall 38 and an inner surface 58A; and sealing sections 78 on upper and lower surfaces of the risers 40, 40A, 46. The upper section 46 can have a vertical partition wall 84 extending from an inner surface of a first sidewall of the upper section 46 to an inner surface of a second sidewall of the upper section 46 such that the vertical partition wall 84 is substantially perpendicular to the first and second sidewalls. The vertical partition wall 84 separates the valve vault chamber 16 from the wet well chamber 6. The floor of the base 30 includes a sloped portion 42 proximate one arcuate end of the bottom riser 40A and extending toward a center of the base 30. The base 30 also included a beveled corner section 48 positioned between the floor (i.e., upper surface of the base slab 31) and the inner surface 58A of the perimeter wall 38. In some embodiments, the beveled corner section 48 extends around the entire perimeter of the inner surface 58A of the perimeter wall 38.

One embodiment of the pump station body 10 can utilize stock prefabricated structural components for ease of production and/or reduced production costs. In various embodiments, the pump station base 30, two-foot risers 40, three-foot risers 40, four-foot risers 40, an integral valve vault chamber 16, and access covers 36 with or without hatches are all stock components that can be inventoried at the production facility for ultimate cost savings and a reduction in product assembly time. Also, the use of stock structural components reduces the time required for project submittals. All stock structural components are designed and PE stamped for final installation. Additionally, precast concrete sections may conform to the latest requirements of ACI 350.

In various embodiments the precast components (e.g., bottom riser, risers, upper section, and top slab, etc.) are fabricated on steel forms with machined rings to form accurate bell and spigot joint surfaces to ensure water-tightness. All horizontal joints between precast sections may be sealed with a vulcanized butyl rubber joint material conforming to AASHTO M-198 or a similar standard. In one embodiment, the joint material is Conseal CS-102 as manufactured by Concrete Sealants. In alternate embodiments, the joints or interconnection points 80 are comprised of other configurations including O-ring joints and wedge gasket joints, as well as other joints known in the art.

In one embodiment, the height and depth of the valve vault chamber is adjustable. Accordingly, the upper section 46 of the pump station body 10 comprises a shelf upon which the valve vault chamber 6 can be set. Thus, the divider between the wet well chamber 16 and the valve vault chamber 6 shown in FIG. 4 would not be a part of the upper portion 46 according to this embodiment because the valve vault chamber 6 set into the pump station body 10 could comprise this divider. In one embodiment, the shelf could be monolithic and cast in with the precast body section (e.g., the upper section 46 or a riser 40). In some embodiments, the valve vault chamber 6 is also precast and positioned on the shelf upon installation. In an alternate embodiment, a riser 40 may comprise the shelf upon which the valve vault chamber 6 will be placed. According to this embodiment, the height of the upper section 46 could vary depending on the desired depth of the valve vault chamber 6. In an alternative embodiment, a valve vault riser with a partition wall is placed above the upper section 46 and below the top slab 20 such that the height of the valve vault chamber 16 is increased.

Figure 5:
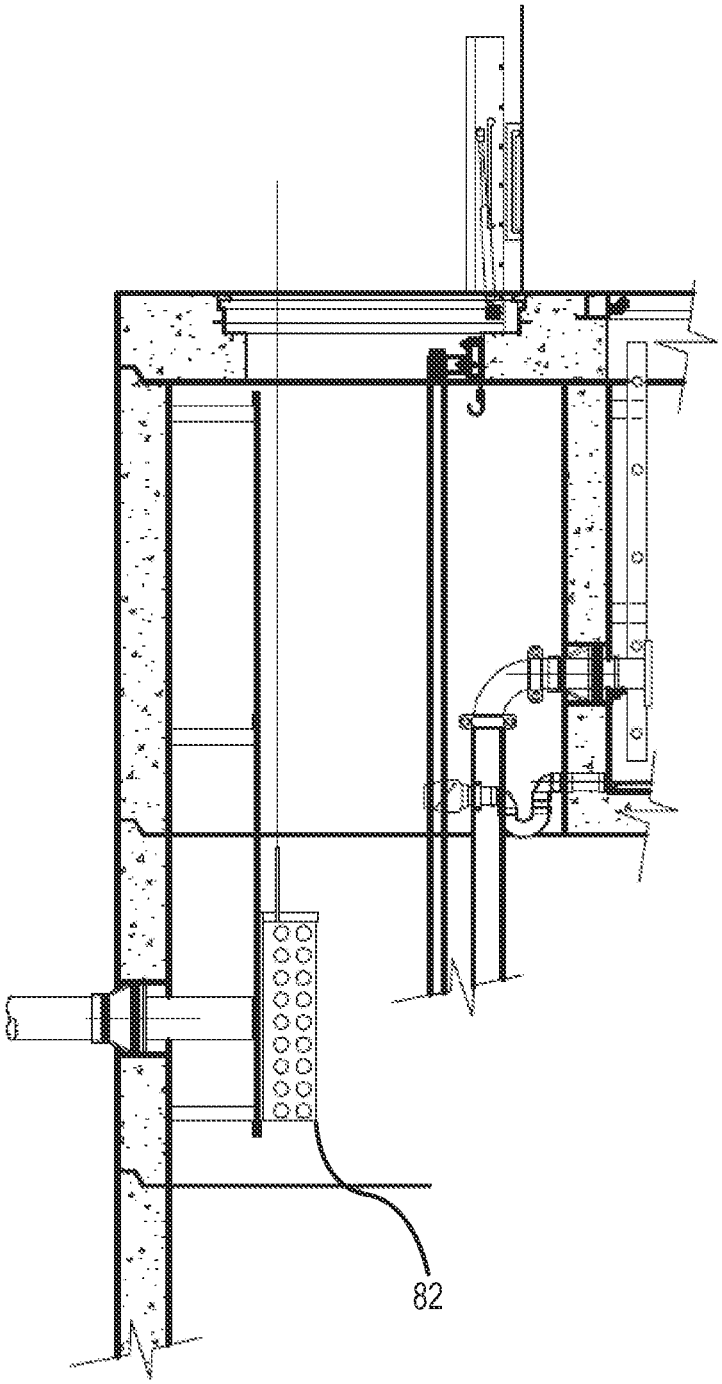
FIG. 5 is a cross-sectional elevation view of a section of an embodiment of a wet well collection chamber.

FIG. 5 is a cross-sectional elevation view of a section of an embodiment of a wet well collection chamber. In the embodiment shown, the pumping station is supplied with a trash basket straining system 82 mounted on an aluminum rail guide system for easy extraction from grade elevation, similar to the pumps. Because the wet well hatch is set in size and location, the inlet pipe to the pumping station should come in through an end wall, perpendicular to and in the center of the end wall, which will position the interior trash basket centrally relative to the wet well hatch above. Based on the pumping equipment size, the trash basket sitting above the pumps may interfere with the removal of the pump and as such the trash basket may have to be removed first, prior to the pump removal.

One embodiment of a trash basket assembly 82 comprises a trash basket with low-flow, that is light-weight, and that has a thin-profile, and perforated holes. An alternate embodiment comprises a trash basket with higher flow, a larger profile, and a heavy-duty bar screen construction. In one embodiment, a stainless steel trash basket assembly is used. The trash basket and rail system may also be composed of stainless steel materials.

In some embodiments, the pump station is supplied with portable hoisting equipment for pump and trash basket removal. The hoisting equipment will utilize exterior wall mounted sockets which are permanently mounted to the pump station structure. The hoist and wall mounts can be constructed of 304 stainless steel. The winch is hand-operated and the hoist reach is adjustable from 24" to 36". In embodiments where a portable hoist option is selected, dedicated lifting cables will be provided for each pump and trash basket option (if selected). The dedicated lifting cable is designed to mesh with the winching equipment provided and is expected to be coiled and stored in the hatchway when not in use. Hoisting capacity options include a 300 lb. lifting capacity and a 1000 lb. lifting capacity.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments for the purpose of streamlining the disclosure.

Moreover, though the present disclosure has included description of one or more embodiments and certain variations and modifications, other variations and modifications are within the scope of the disclosure, e.g. the use of a certain component described above alone or in conjunction with other components may comprise a system, while in other aspects the system may be the combination of all of the components described herein, and in different order than that employed for the purpose of communicating the novel aspects of the present disclosure. Other variations and modifications may be within the skill and knowledge of those in the art, after understanding the present disclosure. This method of disclosure is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A multi-part, precast concrete enclosure for a below-grade pumping station for moving liquids, comprising:

a top slab;

a monolithic, precast concrete upper section comprising:

two vertically extending sidewalls and two arcuate end sections;

a vertical partition wall extending from one vertically extending sidewall to the other vertically extending sidewall;

a horizontal floor extending from one of said two arcuate end sections to said vertical partition wall;

a portion of a water collection chamber positioned on one side of said vertical partition wall; and a valve chamber positioned on the other side of said vertical partition wall and separated from said water collection chamber by said horizontal floor and said vertical partition wall, wherein said upper section is engaged on an upper end to a lower surface of said top slab, wherein an upper surface of said vertical partition wall is in contact with said lower surface of said top slab, and wherein said monolithic, precast concrete upper section is one piece;

an inlet positioned proximate to said water collection chamber, wherein said inlet allows fluid to enter said water collection chamber;

an outlet positioned proximate to said valve chamber;

a precast concrete bottom section further defining said water collection chamber, said bottom section comprising:

a concrete base slab with an upper surface and a perimeter edge; and a wall extending upwardly from said upper surface of said concrete base slab, said wall comprising vertically extending sidewalls and arcuate end sections which define a footprint;

a sloped floor portion extending upwardly from a center portion of said upper surface of said concrete base slab to a portion of an inner surface of said wall;

a beveled corner section joining a lower portion of said inner surface of said wall to a portion of said upper surface of said concrete base slab, wherein said beveled corner section has a first height as measured from said upper surface of said concrete base slab to a top of said beveled corner section, and wherein a tallest portion of said sloped floor portion as measured from said upper surface of said concrete base slab to a top of said sloped floor portion has a second height that is taller than said first height of said beveled corner section; and wherein said bottom section is monolithic;

a first access opening for access into said water collection chamber;

a second access opening for access into said valve chamber;

wherein said bottom section and said upper section are sealingly engaged;

wherein said valve chamber is positioned entirely within said footprint of said precast concrete bottom section; and wherein said valve chamber is positioned in an upper 33% of said precast concrete enclosure as measured between said concrete base slab and said top slab.

2. The enclosure of claim 1, wherein a lower end of said wall of said bottom section is thicker than an upper end of said wall.

3. The enclosure of claim 1, wherein said enclosure further comprises a first riser section comprising vertically extending sidewalls and arcuate end sections, wherein said first riser section is positioned between said upper section and said bottom section to selectively alter a height of said precast concrete enclosure.

4. The enclosure of claim 3, further comprising a second riser section comprising vertically extending sidewalls and arcuate end sections, wherein an upper surface of said second riser section is sealingly engaged to a lower surface of said first riser section, wherein a lower surface of said second riser section is interconnected to an upper surface of said wall of said bottom section, wherein said first riser section has a third height and said second riser section has a fourth height, and wherein said third height is not equal to said fourth height.

5. The enclosure of claim 3, wherein said top slab, said first riser section, and said bottom section are precast of wet cast self-consolidating concrete.

6. The enclosure of claim 1, wherein said valve chamber comprises a valve assembly, and wherein said valve assembly comprises at least one of a water meter, a backflow preventer valve, and a pressure reducing valve.

7. The enclosure of claim 1, wherein the concrete is at least partially comprised of an antimicrobial admixture.

8. The enclosure of claim 1, further comprising a discharge line extending from said water collection chamber through an aperture in said vertical partition wall through said valve chamber and out said outlet.

9. A below-grade pumping station for collecting and moving liquids, comprising:

a height-adjustable, precast concrete enclosure comprising:

a top slab having a substantially planar upper surface, arcuate ends, and at least one access opening;

a monolithic, precast concrete upper section comprising a first vertically extending sidewall, a second vertically extending sidewall, a first arcuate end section, a second arcuate end section, a vertical partition wall extending from said first vertically extending sidewall to said second vertically extending sidewall, a horizontal floor extending from said first arcuate end section to said vertical partition wall, a portion of a collection chamber positioned on one side of said vertical partition wall; and a valve chamber positioned on the other side of said vertical partition wall and above said horizontal floor, wherein said upper section is interconnected on an upper end to said top slab;

an inlet positioned proximate to said internal collection chamber, wherein said inlet allows fluid to enter said collection chamber;

an outlet positioned proximate to said valve chamber;

a monolithic, precast concrete bottom section further defining said collection chamber, said bottom section comprising:

a base slab having a lower surface, an upper surface, and a perimeter edge;

a perimeter wall extending upwardly from said upper surface of said base slab and positioned within said perimeter edge, and said perimeter wall positioned directly below said first and second vertically extending sidewalls and said first and second arcuate end sections of said upper section;

an interior junction between said perimeter wall and said upper surface of said base slab;

a beveled corner section extending at least partially around said interior junction; and a sloped floor section positioned proximate said upper surface of said base slab, wherein said sloped floor section extends from an arcuate end of said perimeter wall toward an opposing arcuate end of said perimeter wall to promote drainage of the liquids;

a pump;

a discharge line interconnected on a first end to said pump and interconnected on a second end to said outlet, wherein said discharge line extends through an aperture in said vertical partition wall and through said valve chamber;

a valve assembly positioned within said valve chamber and interconnected to said discharge line;

at least one of a float switch and a level sensor; and a vent.

10. The below-grade pumping station of claim 9, further comprising one or more intermediate riser sections comprising vertically extending sidewalls and arcuate end sections, wherein said one or more intermediate riser sections are positioned between said upper section and said bottom section to selectively alter a height of said precast concrete enclosure.

11. The below-grade pumping station of claim 9, wherein said monolithic bottom section is precast of wet cast self-consolidating concrete.

12. The below-grade pumping station of claim 9, further comprising a second access opening in said top slab, wherein said second access opening provides access into said valve chamber, wherein said perimeter wall of the monolithic, precast concrete bottom section extends upwardly from said base slab above said beveled corner section and said sloped floor section and comprises a lower portion proximate the base slab and an upper portion positioned above said lower portion, and wherein said lower portion of said perimeter wall is thicker than said upper portion of said perimeter wall.

13. The below-grade pumping station of claim 9, wherein said valve assembly comprises a check valve.

14. The below-grade pumping station of claim 9, wherein an upper surface of said vertical partition wall is in direct contact with a lower surface of said top slab.

* * * * *